US012078444B2

(12) United States Patent
Wood et al.

(10) Patent No.: US 12,078,444 B2
(45) Date of Patent: Sep. 3, 2024

(54) GAS PROJECTILE PLATFORM AND ASSEMBLY

(71) Applicant: War Machine, Inc., Taylors, SC (US)

(72) Inventors: Michael Wood, Taylors, SC (US); Chris Vandenberghe, Taylors, SC (US)

(73) Assignee: War Machine, Inc., Taylors, SC (US)

( * ) Notice: Subject to any disclaimer, the term of this patent is extended or adjusted under 35 U.S.C. 154(b) by 72 days.

(21) Appl. No.: 17/953,109

(22) Filed: Sep. 26, 2022

(65) Prior Publication Data

US 2023/0102220 A1 Mar. 30, 2023

Related U.S. Application Data

(60) Provisional application No. 63/248,608, filed on Sep. 27, 2021.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
None
See application file for complete search history.

(56) References Cited

U.S. PATENT DOCUMENTS 1,519,806 A * 12/1924 Wesson ..... F41A 9/47 42/11
3,736,839 A * 6/1973 Childers ..... F41A 19/39 89/193
5,881,707 A 3/1999 Gardner, Jr.
5,967,133 A 10/1999 Gardner, Jr.
6,035,843 A 3/2000 Smith et al.
6,474,326 B1 11/2002 Smith et al.
6,637,421 B2 10/2003 Smith et al.
6,644,295 B2 11/2003 Jones
6,889,682 B2 5/2005 Styles et al.
(Continued)

FOREIGN PATENT DOCUMENTS

CN 101432591 5/2009
CN 105849500 8/2016
(Continued)

*Primary Examiner* — Derrick R Morgan

(74) *Attorney, Agent, or Firm* — Kim and Lahey Law Firm, LLC; Douglas W. Kim

(57) ABSTRACT

A gas projectile platform having a trigger that can rotate when pressure is applied to the trigger, a first spool biased against a magnet, a pad assembly that, when actuated, allows pressure to enter an first spool pressure area forward the first spool and configured to release the first spool from the magnet when sufficient pressure is transferred to the first spool pressure area, the first spool configured to transmit pressure to a second spool wherein the second spool is configured to be positioned rearward overcoming a spring force to allow press to release from a bolt pressure area, wherein the bolt pressure area is pressurized when the bolt is in a forward position and configured to transition rearward when the second spool overcomes the spring force and wherein an ejection pressure stored in a bolt pressure area is transmitted to a chamber and ejects a projectile from a barrel.

17 Claims, 3 Drawing Sheets

(56) References Cited

U.S. PATENT DOCUMENTS 6,990,971 B1* 1/2006 Moritz ..... F41B 11/723 124/31
7,100,593 B2 9/2006 Smith et al.
7,150,276 B1 12/2006 Rice
7,461,646 B2 12/2008 Jones
7,603,997 B2 10/2009 Hensel et al.
7,610,907 B1* 11/2009 Coray ..... F41B 11/722 124/75
7,610,908 B2 11/2009 Garder, Jr. et al.
7,770,572 B2* 8/2010 Lian ..... F41B 11/723 124/75
7,866,308 B2* 1/2011 Jones ..... F41B 11/00 124/71
7,946,285 B2 5/2011 Gardner, Jr. et al.
7,984,708 B2 7/2011 Pedicni et al.
8,286,621 B2 10/2012 Halmone
8,555,868 B2 10/2013 Dobbins
8,651,096 B2 2/2014 Sikes
8,833,352 B2* 9/2014 Pham ..... F41B 11/70 124/73
RE45,490 E 4/2015 Italia et al.
9,080,832 B2 7/2015 Brahler, II et al.
9,182,191 B2 11/2015 Gardner, Jr. et al.
10,642,044 B2 5/2020 Ouderkirk et al.
10,914,545 B2 2/2021 Masse
2006/0005822 A1* 1/2006 Quinn ..... F41B 11/723 124/73
2006/0005823 A1 1/2006 Quinn et al.
2006/0027221 A1* 2/2006 Farrell ..... F41B 11/723 124/31
2006/0037597 A1 2/2006 Wood
2006/0162787 A1* 7/2006 Yeh ..... F41B 11/72 137/596.17
2007/0028909 A1 2/2007 Wood
2007/0113835 A1* 5/2007 Yeh ..... F41B 11/723 124/73
2007/0151549 A1* 7/2007 Wood ..... F41B 11/723 124/73
2007/0227519 A1 10/2007 Wood
2008/0041353 A1* 2/2008 Gan ..... F41B 11/721 124/63
2009/0101129 A1 4/2009 Wood et al.
2012/0227724 A1* 9/2012 Soueidan ..... F41B 11/723 124/73
2014/0096758 A1* 4/2014 Gardner, Jr. ..... F16K 27/044 124/73
2014/0338649 A1* 11/2014 Williams ..... F41B 11/62 29/401.1
2015/0300771 A1* 10/2015 Tseng ..... F41B 11/62 124/74
2018/0142984 A1* 5/2018 Harvey ..... F41B 11/62
2019/0257612 A1* 8/2019 Gardner, Jr. ..... F41B 11/723
2021/0102639 A1* 4/2021 Wood ..... F16K 31/16
2021/0299357 A1* 9/2021 Kalmanson ..... A61M 5/2053
2023/0035677 A1* 2/2023 Ruck ..... F41A 3/10
2023/0065490 A1* 3/2023 Paterson ..... F15B 15/204
2023/0332860 A1* 10/2023 Schoonmaker ..... F41B 11/73

FOREIGN PATENT DOCUMENTS

WO 1997026498 7/1997
WO 2008097265 8/2008

* cited by examiner

GAS PROJECTILE PLATFORM AND ASSEMBLY

RELATED APPLICATIONS

This application is a non-provisional patent application claiming priority from U.S. Provisional Patent Application 63/248,608 filed Sep. 27, 2022 which is incorporated by reference.

BACKGROUND OF THE INVENTION

1) Field of the Invention

This system is directed to the action and assembly for a compressed gas gun, including a paintball gun.

2) Description of the Related Art

Gas powered guns, including paintball guns that can be used in paintball activities typically use compressed gas for firing projectiles. Generally, these guns are known, but lack consistency with the pressures that is used to propel and eject the projectile from the gun. It is a known problem that with traditional guns, the pressure or actuation of the trigger can affect the pressure that is used to eject a projectile. For example, if a trigger is partially depressed, it is possible for the pressure in the gun to "leak" so that the pressure used to eject the projectile is lower than optimal.

Therefore, it is one objective of this system to provide a consistent pressure for ejecting a projectile that is not reliant upon the pressure applied to the trigger.

BRIEF SUMMARY OF THE INVENTION

The above objectives are accomplished by providing a gas gun projectile platform comprising: a frame; a trigger carried by the frame that can rotate when pressure is applied to the trigger; a first spool biased against a magnet; a pad assembly that, when actuated, allows pressure to enter a first spool pressure area that is forward the first spool and configured to release the first spool from the magnet when sufficient pressure is transferred to the first spool pressure area; the first spool configured to transmit pressure to a second spool wherein the second spool is configured to be positioned rearward overcoming a spring force to allow pressure to release from a bolt pressure area; wherein the bolt pressure area is pressurized when the bolt is in a forward position and configured to transition rearward when the second spool overcomes the spring force; and, wherein an ejection pressure stored in a bolt pressure area is transmitted to a chamber and ejects a projectile from a barrel.

The first spool can be attracted to a magnet disposed in the frame and the trigger is configured to allow pressure to overcome the attraction and separate the first spool from the magnet. A follower can be configured to actuate when the trigger is actuated and configured to allow pressure to overcome the attraction and separate the first spool from the magnet. The second spool can be biased by a spring disposed in the frame and the trigger is configured to allow pressure to overcome the spring and position the second spool rearward.

BRIEF DESCRIPTION OF THE SEVERAL VIEWS OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

With reference to the drawings, the invention will now be described in more detail.

Figure 1:
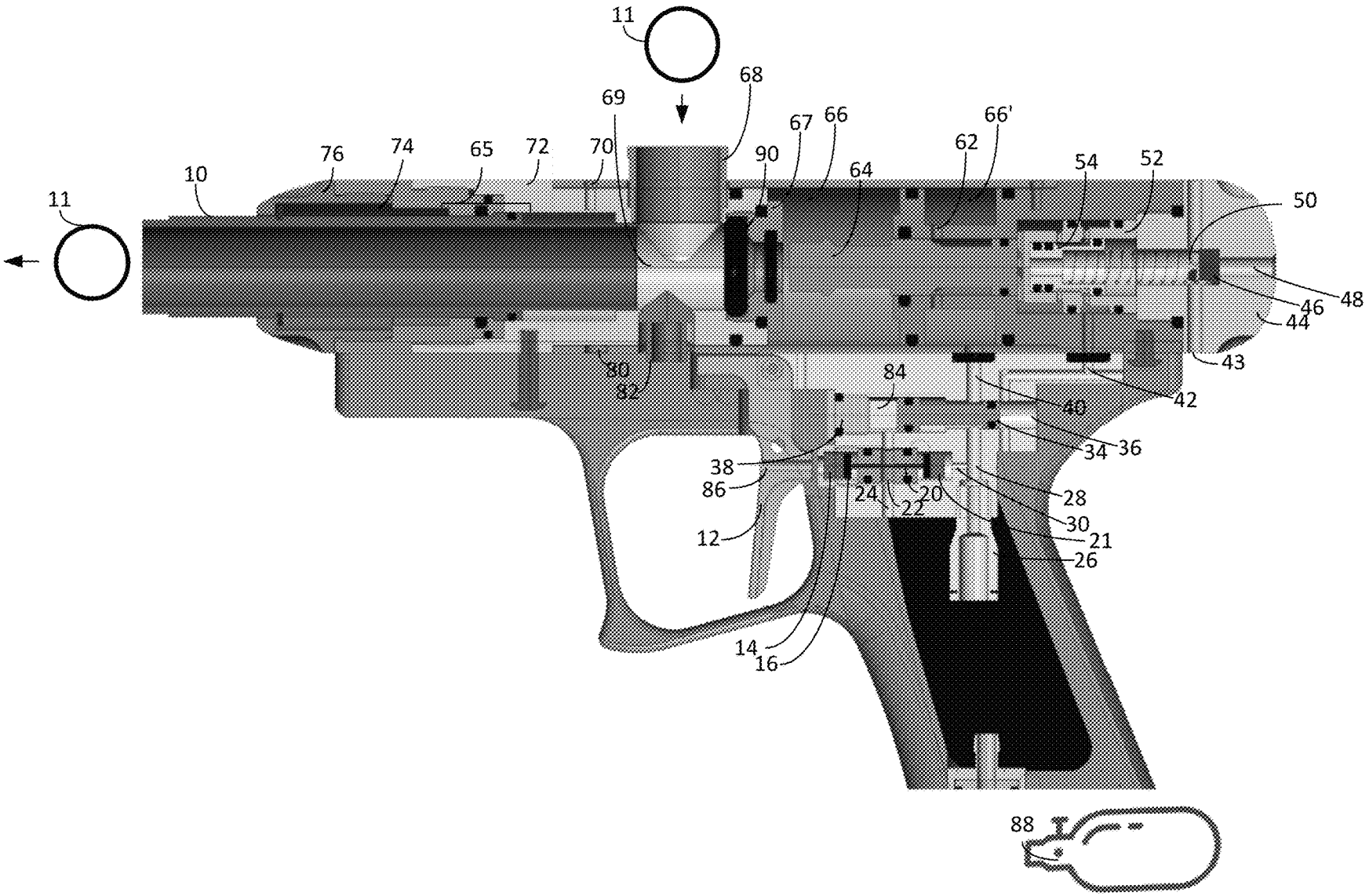
FIG. 1 is a cut away view of an assembled compressed gas gun according to the invention.

Referring to FIG. 1, a compressed fluid (e.g., air) source 88 is shown that can be removably connected to a gun frame. The fluid can be transmitted from the insertion point into the action area of the gun through supply port 26. The fluid can be routed into path 30 so that fluid is directed into an area around the first valve 22. The pressure in the supply port biases the follower in a closed position preventing fluid from entering the area around the first valve 22. When the trigger is pulled, the trigger 12 contacts forward pad 16 of follower 14 which causes the first valve 22 to allow fluid pressure to enter into the area around magnet 84. The magnetic can be support by member 38. The follower can include a forward pad 16, shaft 20 and rear pad 21.

Once the pressure in the area forward of the first spool 34 increases sufficiently to move first spool 34 so that the magnetic attraction between the magnet 84 and the first spool is overcome the first spool 34 releases from the magnet and moves rearward. The first spool travels rearward into space 36 sending a pressure signal through path 42 into a space around the second spool 54. The second spool can include one or more O-rings to seal the second spool in member 52. When the first spool releases from the magnet, the pressured fluid enters path 40 and fill area 66'. Fluid pressure from area 66' moves to area 66 and causes ejection of the projectile 11. Areas 66 and 66' contain fluid pressure for ejecting the projectile and area 66' stores fluid pressure until first spool 34 causes second spool 56 to move rearward. When the bolt moves forward and rearward, pressure can enter the pressure areas 66' through opening 62.

A trigger adjustment screw or other member can extend through path 86 and allow for the length of pull to be adjusted.

The bolt 64 is in a forward position while the pressure in 66' is increased and stored. The bolt prevents the fluid pressure in area 66' from entering the chamber including areas 66 and 69. When spool 34 is released, fluid pressure causes the second spool 54 to overcome the spring 50 tension and move rearward. The spring tension can be changed by adjustment 46 so that the amount of pressure required to position the second spool from a forward position to a rearward position can be modified. The pressure in the read of the frame and associated with the second spool can be released from the frame through opening 43 and 48 defined in an end member 44.

When the trigger 12 is actuated, the second spool (e.g., timing valve) 54 controls fluid pressure acting on the rear side of the bolt 64. When fluid pressure is released, the fluid pressure around the bolt is directed into the chamber to eject the projectile.

When the bolt 64 is positioned forward, a projectile can be in the chamber for ejection. When first spool 34 moves rearward, the pressure holding the bolt forward is released, pressure from the area 66' is then allowed to flow into area 66 and against the projectile, the barrel is in a rearward position and the projectile is ejected from the barrel. Once ejected, the barrel can move forward allowing a second projectile to enter the chamber. The barrel can be configured to be disposed forward when out of battery to receive a projectile in a chamber and to be disposed rearward when in battery. A detent can be included and configured to place a projectile rearward against a seal when the projectile is placed in the chamber. The trigger can include an adjustment configured to modify the length of pull of the trigger. A spring adjustment can be included and configured to modify the pressure required to move the second spool rearward. When a projectile enters the chamber, it can contact detent 82, which positions the projectile rearward and against seal 90. When the barrel 10 moves rearward, the detent can be lowered, allowing the barrel to move rearward.

A barrel pressures area 74 can be in fluid communications with area 66 or area 66' so that when fluid pressure is building in area 66 or 66', the barrel is moved rearward to close the chamber. When the bolt 64 moves rearward, the fluid pressure is transferred to the barrel and projectile is ejected by fluid pressure from the barrel, and barrel is moved forward. The frame can include an endcap 76 that can secure the barrel to the frame. The frame can include a read barrel housing 72 that can include a barrel pressure release port 70.

Figure 2:
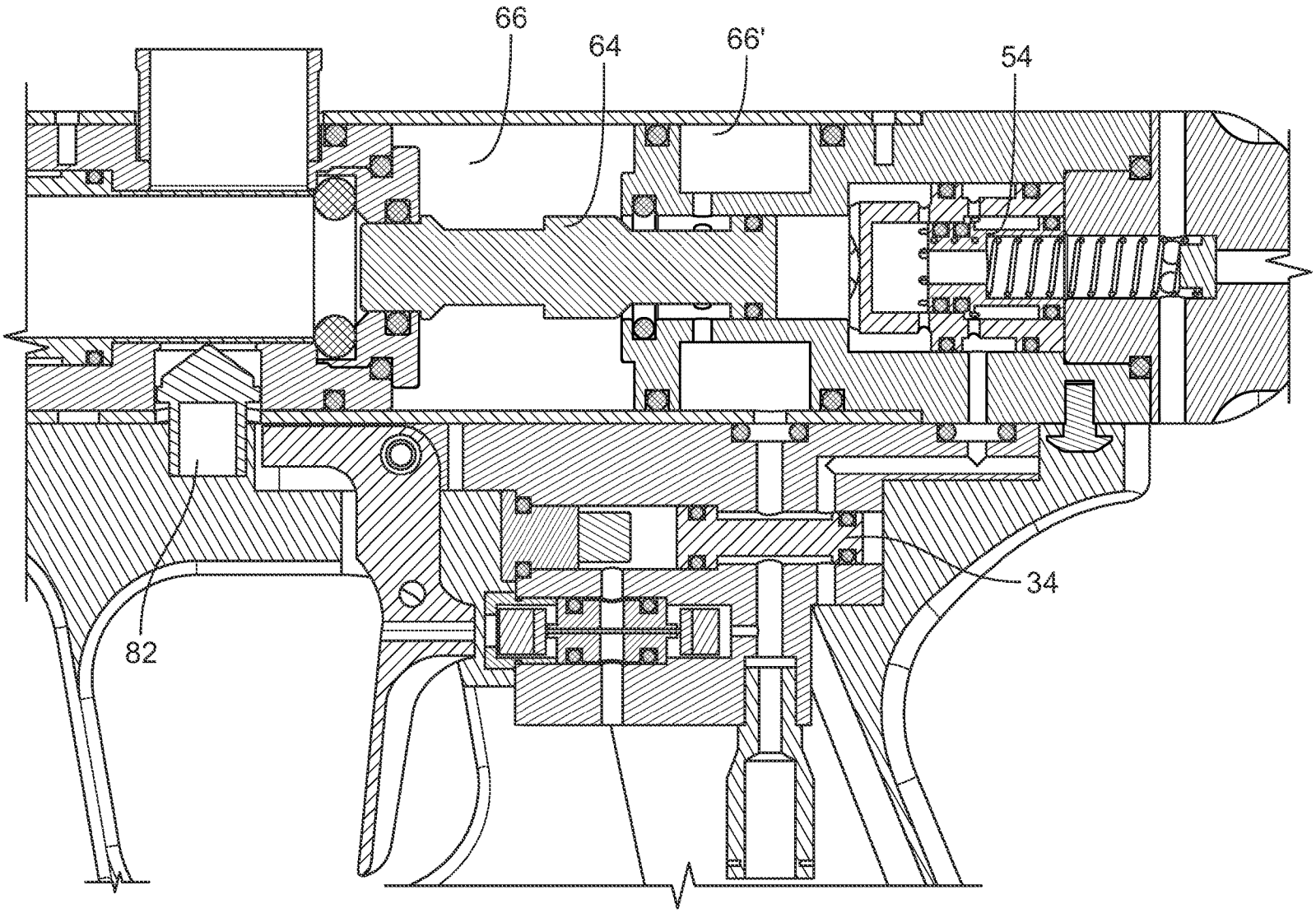
FIG. 2 is a cut away partial view of an assembled compressed gas gun according to the invention.

Referring to FIG. 2, the barrel 10 is shown in the rear position and the bolt 64 in the forward position. In this position, a projectile can in the chamber and/or the barrel while fluid pressure is being stored or is stored in areas 66 and 66'. When the trigger is actuated and the first spool 34 is positioned rearward, fluid pressure moves the second spool 54 rearward. Pressure is then released from the rear of the bolt allowing the bolt to move rearward. Fluid pressure ejects the projectile. In one embodiment, the barrel 10 moving rearward depresses the detent 82, allowing the barrel to move rearward.

Figure 3:
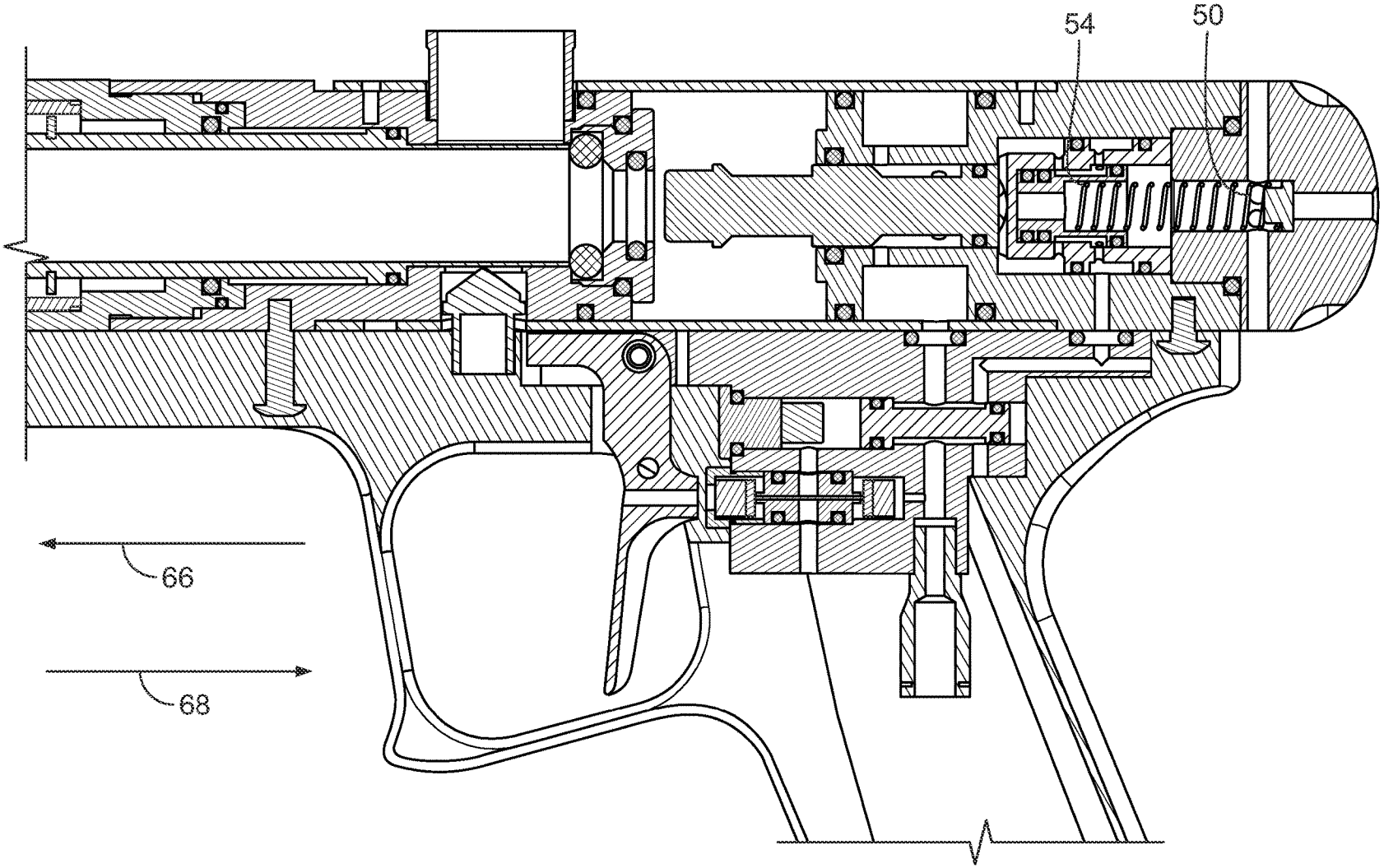
FIG. 3 is a cut away partial view of the assembled compressed gas gun of FIG. 2 in another configuration.

Referring to FIG. 3, the second spool 54 is moved forward by spring 50 as fluid pressure positioning the second spool rearward is released. Pressure is then allowed to build in area 66 and 66'

The gas gun can include a first stage wherein fluid pressure is gathered in a bolt pressure area 66 and 66' from an external pressure source, a bolt 64 is in a forward position, a first spool 34 is in a forward position and a second spool 54 is in a forward position; a second stage wherein the first spool is positioned rearward when a predetermined amount of pressure is transferred to around the first spool, the second spool is positioned rearward overcoming the force of a spring and releasing pressure on a bolt, the bolt is moved rearward configured to allow the bolt pressure to transfer to a projectile to eject the projectile; and, a third stage where the first spool is positioned forward, the second spool is positioned forward, the bolt is positioned forward and the trigger is reset. Fluid can flow between the bolt pressure area 66 into chamber 69 and into barrel pressures area 74 along fluid pathway 65.

In one embodiment, the stages of operation include a first stage where the projectile is disposed in the chamber and the barrel it in a forward position. A forward position is shown as a direction 92 and a rearward direction is shown as a direction 94. The projectile is disposed rearward by the detent 82 and can be adjacent to and against a seal 90. The seal can be carried by seal member 67 that can be configured to receive the bolt. The barrel moves to a rearward position. The bolt is 64 is in a forward position and pressure is stored on area 66 and/or 66'.

The second stage includes the trigger 12 being actuated which causes the first spool 34 to move rearward due to pressure traveling along supply path 28 to position the first spool rearward. The positioning of the first spool rearward allows for pressure to travel along path 42 and into area around the second spool 54 causing the second spool to move rearward, overcoming the force of the spring 50. When the second spool moves rearward, the bolt is allowed to move rearward.

In a third stage, the bolt moves rearward and pressure that has gathered in area 66 and 66' is allowed to escape into the chamber and eject the projectile. A pathway from area 66 to area 74 positioning the barrel forward. The chamber is opened allowing a second projectile to enter the chamber. The bolt is moved forward, and pressures is again gathered in areas 66 and 66'. The second spool returns forward, and the trigger is reset.

The gas gun projectile platform may include: a frame; a trigger carried by the frame that can rotate when pressure is applied to the trigger; a first spool biased against a magnet; a pad assembly that, when actuated, allows pressure to enter a first spool pressure area forward the first spool and configured to release the first spool from the magnet when sufficient pressure is transferred to the first spool pressure area; the first spool configured to transmit pressure to a second spool wherein the second spool is configured to be positioned rearward overcoming a spring force to allow pressure to release from a bolt pressure area; wherein the bolt pressure area is pressurized when the bolt is in a forward position and configured to transition rearward when the second spool overcomes the spring force; and, wherein an ejection pressure stored in a bolt pressure area is transmitted to a chamber and ejects a projectile from a barrel.

The first spool can be attracted to a magnet disposed in the frame and the trigger is configured to allow pressure to overcome the attraction and separate the first spool from the magnet. A follower can be configured to actuate when the trigger is actuated and configured to allow pressure to overcome the attraction and separate the first spool from the magnet. The second spool can be biased by a spring disposed in the frame and the trigger is configured to allow pressure to overcome the spring and position the second spool rearward.

It is understood that the above descriptions and illustrations are intended to be illustrative and not restrictive. It is to be understood that changes and variations may be made without departing from the spirit or scope of the following claims. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A gas projectile platform comprising:

a frame having supply port adapted to received fluid from an external supply;

a follower carried by the frame and biased in a closed position according to an initial pressure;

a first spool carried by the frame and biased in a first spool closed position by a magnet wherein movement of a trigger transitions the follower to a follow open position releasing a fluid pressure that acts upon the first spool, the fluid pressure forcing the first spool away from the magnet and transitioning the first spool into a first spool open position that causes transmission of the fluid pressure to a second spool, wherein the second spool is moved by the fluid pressure causing a bolt pressure to release from a bolt pressure area;

wherein the bolt pressure is transmitted to a chamber to eject a projectile; and a pathway from a bolt pressure area to a barrel pressure area so that a barrel is transitioned rearward when the projectile is ejected from the barrel.

2. The platform of claim 1, wherein the second spool is biased in a resting position by a spring, and the second spool is moved by the fluid pressure to compress the spring.

3. The platform of claim 1 including a detent configured to place the projectile rearward against a seal when the projectile is placed in the chamber.

4. The platform of claim 1 including an adjustment configured to modify a length of pull of a trigger adapted to contact the follower when actuated.

5. The platform of claim 1 including a spring adjustment configured to modify the fluid pressure required to move the second spool rearward.

6. A gas projectile platform comprising:

a frame;

a first stage wherein pressures is gathered in a bolt pressure area included in the frame from an external pressure source, a bolt carried by the frame disposed is in a forward position, a first spool carried by the frame and disposed in a first spool closed position and a second spool carried by the frame is in a second spool closed position;

a second stage wherein the first spool is positioned in an first spool open position when a predetermined amount of pressure is transferred to around the first spool when a trigger is actuated, the second spool is positioned in a second spool open position and configured to overcome a force of a spring and releasing pressure on the bolt, the bolt is moved to a release position and configured to allow an ejection pressure to transfer to a projectile to eject the projectile;

a third stage where the first spool is returned to the first spool closed position, the second spool is returned to the second spool closed position, the bolt is returned to the bolt closed positioned and the trigger is reset; and, a fluid pathway between the bolt pressure area and a barrel pressure area so that a barrel is positioned rearward once the projectile is positioned in a chamber during the third stage.

7. The platform of claim 6 wherein the third stage includes fluid pressure being directed to a bolt pressure area through a supply path.

8. The platform of claim 6 including a detent to position the projectile rearward when the projectile is moving into a chamber.

9. The platform of claim 6 wherein the trigger includes an adjustment screw to modify a length of pull.

10. The platform of claim 6 wherein the spring is cooperatively associated with the second spool to bias the second spool in the second spool closed position wherein the spring can include a spring release to modify the pressures required to position the second spool from the second spool closed position to the second spool open position.

11. The platform of claim 6 including a follower that contacts the trigger when the trigger is actuated and configured to allow fluid pressure to enter into a first spool pressure area.

12. The platform of claim 11 wherein the first spool configured to be released from a magnet when the first spool pressure area is sufficient to overcome an attraction of the magnet.

13. A gas projectile platform comprising:

a frame having a bolt pressure area configured to receive and store pressure from a pressure source when a bolt is in a forward position;

a trigger connected to the frame and configured to actuate a follower;

a first spool carried by the frame configured to be actuated when the follower is actuated, and the first spool is configured to allow pressure to actuate a second spool and the second spool is configured to release pressures against the bolt thereby positioning the bolt in a rearward position wherein the bolt is configured to allow a stored pressure to be applied to a projectile to eject the projectile from a barrel; and, a pathway from a bolt pressure area to a barrel pressure area so that the barrel is transitioned rearward when the projectile is ejected from the barrel.

14. The platform of claim 13 wherein the first spool is attracted to a magnet disposed in the frame and the trigger is configured to allow fluid pressure to overcome an attraction and separate the first spool from the magnet.

15. The platform of claim 13 wherein the follower is configured to actuate when the trigger is actuated and configured to allow fluid pressure to overcome an attraction and separate the first spool from a magnet.

16. The platform of claim 13 wherein the second spool is biased by a spring disposed in the frame and the trigger is configured to allow fluid pressure to overcome the spring and transition the second spool in the rearward position.

17. The platform of claim 16 wherein a spring tension of the spring is adjustable.

* * * * *